US005265745A

United States Patent [19]

Pereyra et al.

[11] Patent Number: 5,265,745

[45] Date of Patent: Nov. 30, 1993

[54] TAMPER EVIDENT TOP TAB INNERSEAL

[75] Inventors: Rodger J. Pereyra; Pierre H. LePere, both of Cottage Grove; Wayne K. Morris, Afton; Theresa A. McCarthy, Inver Grove Heights, all of Minn.

[73] Assignee: Minnesota Mining and Manufacturing Company, St. Paul, Minn.

[21] Appl. No.: 17,964

[22] Filed: Feb. 12, 1993

Related U.S. Application Data

[63] Continuation of Ser. No. 865,359, Apr. 8, 1992, abandoned.

[51] Int. Cl.[5] ..... B65D 51/18

[52] U.S. Cl. ..... 215/232; 215/258; 215/305

[58] Field of Search ..... 215/232, 258, 305; 220/359

[56] References Cited

U.S. PATENT DOCUMENTS

| | | | |
|---|---|---|---|
| 4,666,052 | 5/1987 | Ou-Yang | 215/230 |
| 4,684,554 | 8/1987 | Ou-Yang | 428/35 |
| 4,934,544 | 6/1990 | Han et al. | 215/232 |
| 4,960,216 | 10/1990 | Giles et al. | 215/232 |
| 4,961,986 | 10/1990 | Galda et al. | 428/201 |
| 5,004,111 | 4/1991 | McCarthy | 215/232 |

*Primary Examiner*—Allan W. Shoap
*Assistant Examiner*—Nova Stucker
*Attorney, Agent, or Firm*—Gary L. Griswold; Walter N. Kirn; Peter L. Olson

[57] ABSTRACT

A multilayer innerseal having a grip tab extending across the innerseal. Force applied to the grip tab is concentrated at the base of the grip tab and promotes a complete failure of the innerseal. In use, a substantial portion of the original innerseal remains adhered to the container to providing evidence of tampering and to frustrate efforts to reseal the container.

5 Claims, 5 Drawing Sheets

FIG. 5
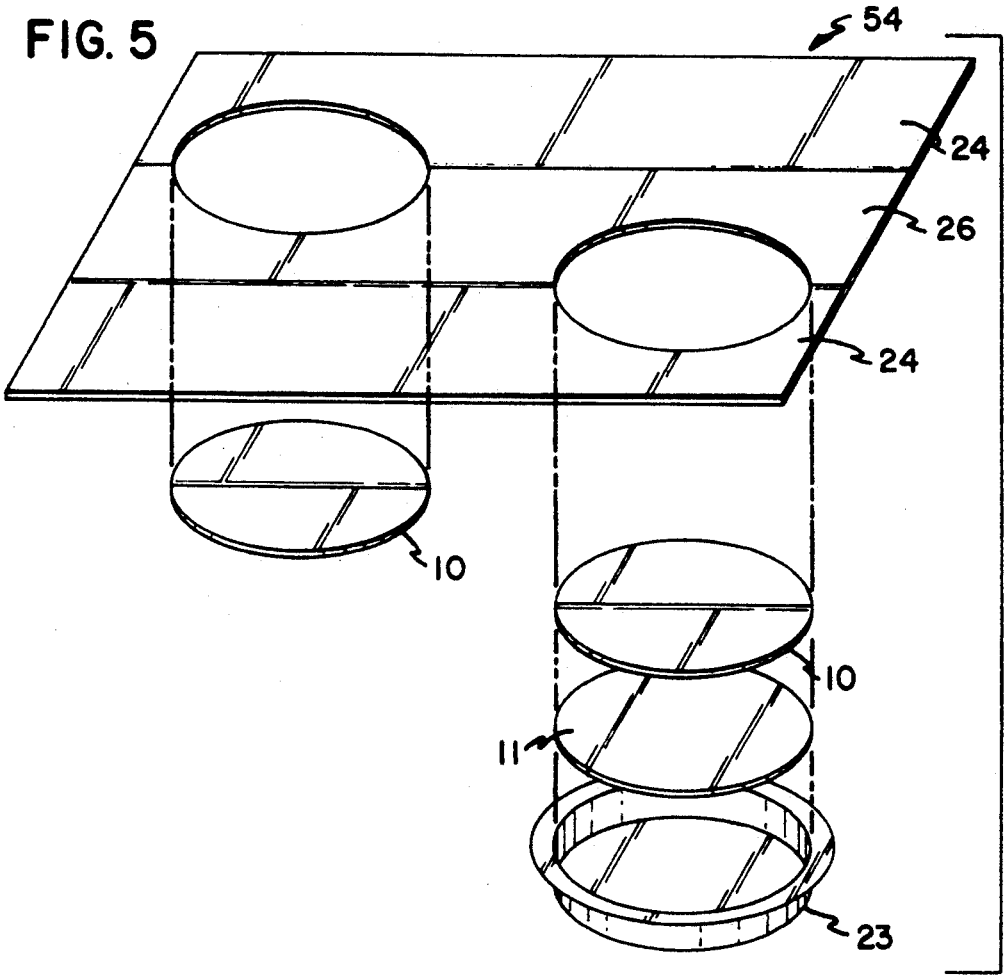
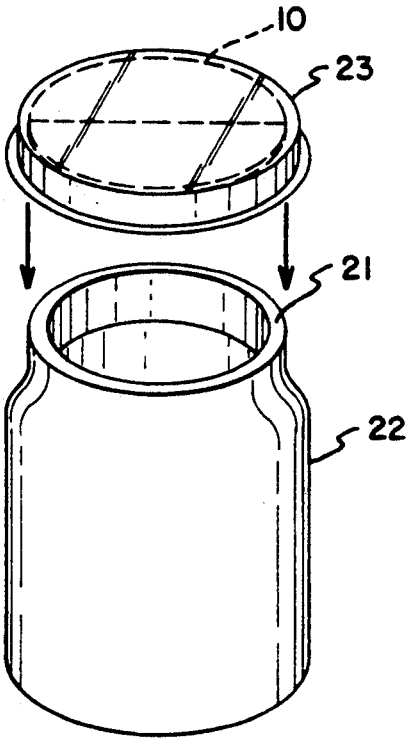
FIG. 6

TAMPER EVIDENT TOP TAB INNERSEAL

This is a continuation of application Ser. No. 07/865,359 filed Apr. 8, 1992, abandoned.

BACKGROUND OF THE INVENTION

1. Field of the Invention

The present invention relates to heat sealable innerseals for use as secondary closures on containers, and a method for producing such innerseals.

2. Description of the Prior Art

Many products are distributed in plastic containers which include screw-on caps, snap-on caps or the like to form the primary closure of the container. In many instances it is desirable to provide a secondary closure for the container in the form of an "innerseal". Typically, an innerseal provides "tamper evidence" and acts as a vapor barrier to protect the product within the container.

One class of innerseals relies on a heat sealable polymeric layer which is bonded to the rim of the plastic container. These innerseals are positioned on the rim of the container and are passed through a radio frequency field which heat seals the innerseal to the container. After opening the primary closure the user may inspect the integrity of the innerseal, and reject the product if the innerseal shows evidence of tampering. Typically the user will pierce the innerseal and cut or tear away the innerseal material to gain access to the product in the container.

Examples of innerseals and related art include:

U.S. Pat. No. 4,684,554 to OuYang which teaches a heat sealable polymeric adhesive to seal an innerseal to a container such that at least 50% of the innerseal material is left on the lip of the jar as the cap is unscrewed and removed.

U.S. Pat. No. 4,666,052 to OuYang discloses a tamper indicating cap assembly having a transparent or translucent cap and an innerseal. When the cap is twisted open, the innerseal membrane is torn apart and evidence of tampering is visible through the cap.

U.S. Pat. No. 4,961,986 to Galda discloses a tabbed innerseal which allows removal of the innerseal as a unit. Although the innerseal of Galda may be easily removed, it is not necessarily tamper-evident.

U.S. Pat. No. 5,004,111 to McCarthy discloses a tabbed innerseal for removal of the innerseal by rupturing the heat sealing layer such that a substantial portion of the heat sealing layer is left on the rim of the container. The rupturing of the heat sealing layer permits easy removal of the innerseal, however the heat sealing layer is not particularly visible on the rim of the container.

SUMMARY OF THE INVENTION

The present invention provides an innerseal that provides evidence of tampering and is easy to open. Structurally, the innerseal has a grip tab which may be grasped by the user to remove a portion of the innerseal. As the user applies force to the innerseal it will fail at the base of the grip tab allowing a portion of the original innerseal to be separated from the container with the grip tab. The innerseal is designed to fail completely at locations proximate the grip tab base during removal, leaving an adherent portion of the original innerseal structure bonded across the rim of the container. This failure mode provides tamper evidence and frustrates any effort to reapply the original innerseal. Innerseal removal may also leave visible segments of innerseal material adhered to the rim of the container indicating the removal of the original innerseal.

Typically, an exemplary innerseal is cut from a multilayer innerseal web and will be generally planar and will be shaped to mate with the rim of the container. For example, if the rim of the container is circular in periphery, the innerseal will have a circular periphery sized to completely cover the opening defined by the rim, with an edge portion sized to coincide with the rim. However, other innerseal shapes are contemplated within the scope of the present invention.

It is common to load the innerseal into a cap along with a pulp board cap liner. Placement of the cap onto the container positions the innerseal adjacent the rim of the container. Next, the innerseal may be applied bonded to the container by an induction heating process. This process completes the application of the innerseal to container.

The illustrative method for making the innerseal web comprises the steps of mating a pair of two ply webs and joining them to a tab liner web in a heated nip. The resultant composite web is sequentially cooled forming an innerseal web. The process may include treating of either one or both webs with a corona discharge, open flame, or the like before they are joined in the nip.

BRIEF DESCRIPTION OF THE DRAWINGS

Throughout the several views of the drawings, like reference numerals refer to identical structure, wherein:

FIG. 5 is a schematic diagram of the process of cutting an innerseal from an innerseal web;

FIG. 6 is a schematic diagram of the process of applying an innerseal to a container;

DETAILED DESCRIPTION OF THE INVENTION

Figure 1:
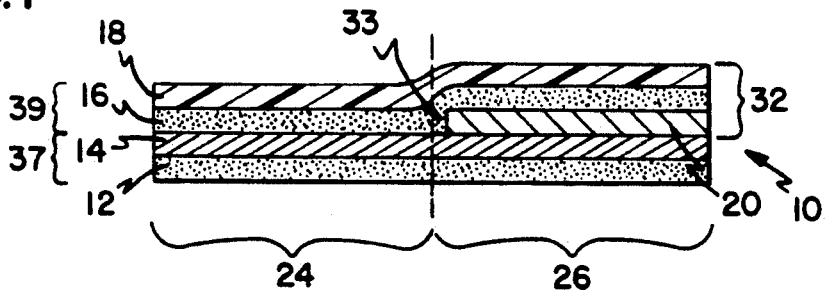
FIG. 1 is an exaggerated-scale cross-section of the innerseal.

FIG. 1 shows a typical innerseal 10 in cross-section. The illustrative innerseal embodiment is circular although other shapes are contemplated within the scope of the invention. A circular innerseal 10 when viewed in cross-section will have a four layer portion 24 over approximately one half of its area, and a five layer portion 26 over the remainder of its area. The bottom bonding layer 12 extends across the entire diameter of the innerseal 10 and is used to bond the innerseal 10 to the container 22. Typical materials for this bottom bonding layer 12 include a heat sealable polymeric material such as polyethylene, polypropylene or ethylene vinyl acetate. In general the optimal bottom bonding layer material depends on the composition of the container 22.

A base layer 14 also extends across the entire diameter of the innerseal 10 and it serves several purposes. When a metallic base layer 14 is used, eddy currents induced in the base layer 14 during the induction sealing process heat this layer which permits a heat seal bond between the bottom bonding layer 12 and the rim of the container to be formed. Although induction heating is preferred, the innerseal can also be sealed with a direct contact, or conduction heat source. Alternate organic and inorganic base layers may be substituted as well. For example, polypyrrole may be heated with microwave radiant energy sources, and polyvinyldene chloride may be heat sealed with contact heating where an oxygen barrier is desirable. The base layer 14 also forms a moisture impermeable layer which is desirable in some applications. Although the preferred metallic base layer 14 is aluminum, other metallic materials may be used.

The base layer 14 and the bottom bonding layer 12 are supplied as a unitary structure during the manufacturing process and together are referred to as the facing or sealing web 37. The intermediate bonding layer 16 extends entirely across the innerseal 10 and is used to couple the top reinforcing layer 18 to the base layer 14 and to adhere the tab liner layer 20 to the top reinforcing layer 18. The intermediate bonding layer 16 is typically formed from ethylene vinyl acetate (EVA) although other polymeric material may be substituted. The tab liner layer 20 extends across a portion of the innerseal 10. The tab liner layer 20 is a de-tackifying layer and is strongly adhered to the intermediate bonding layer 16 but is not adhered to the base layer 14. The presence of this grip tab liner layer 20 forms the grip tab base 33 shown in the drawing. In the particular illustrative embodiment shown the grip tab base 33 also acts as a hinge to permit the user to elevate the grip tab. The top reinforcing layer 18 extends across the entire innerseal 10 and provides strength to the grip tab 32 and the portion of the innerseal 10 opposite the grip tab 32. Preferably the top reinforcing layer 18 is formed from polyester, although other materials may be substituted. During manufacture the top reinforcing layer 18 and the intermediate bonding layer 16 are supplied as a composite assembly referred to as the tabbing web 39.

Figure 2:
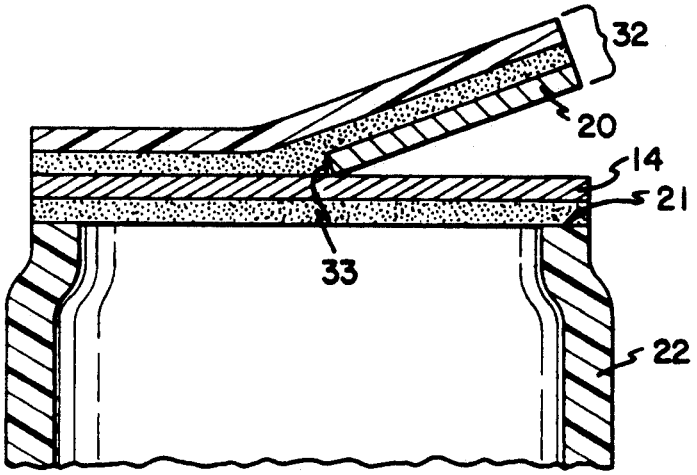
FIG. 2 is an exaggerated-scale cross-section of the innerseal applied to a container.

FIG. 2 shows the innerseal 10 heat-sealed to the rim 21 of a container 22. In this figure, the user has elevated the three layer grip tab 32 in preparation for innerseal 10 removal. Force supplied to the grip tab 32 by the user is concentrated along the grip tab base 33.

Figure 3A:
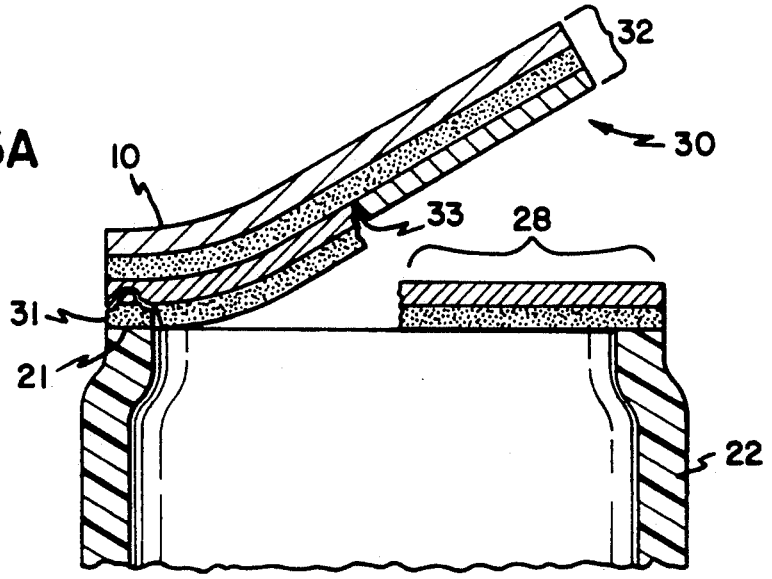
FIG. 3A is an exaggerated-scale cross-section of the innerseal depicting one manner of innerseal failure during removal.

FIG. 3A shows the failure of innerseal 10 from the application of force applied to the grip tab 32. In this figure, the innerseal 10 has failed, producing an adherent portion 28 and a removable portion 30. The adherent portion 28 remains bonded to the container 22 while the removable portion 30 may be discarded. It is desirable to have secondary failures within the base layer 14 to leave bottom layer debris 31 adhered to the rim 21 of the container 22.

Figure 3B:
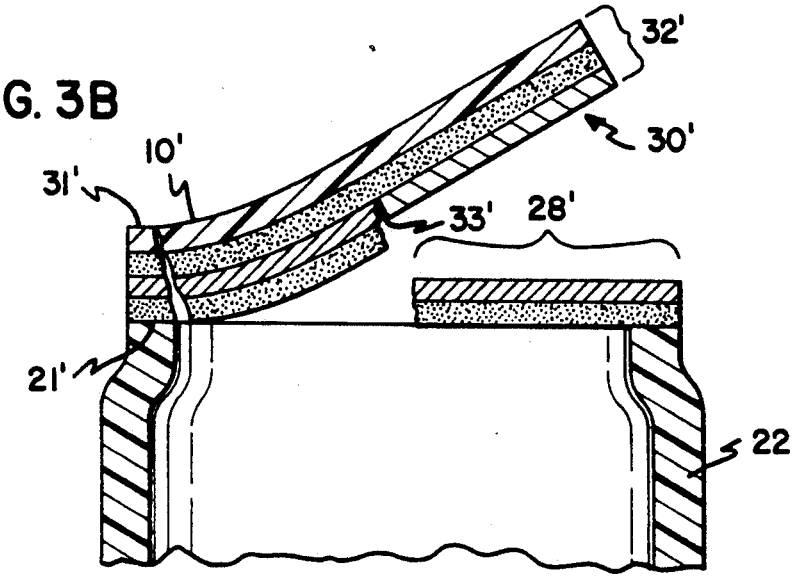
FIG. 3B is an exaggerated-scale cross-section of the innerseal depicting another manner of innerseal failure during removal.

FIG. 3B shows an alternative mode of failure of innerseal 10′ due to application of force applied to grip tab 32′. In this figure, the innerseal 10′ has failed, producing an adherent portion 28′ and a removable portion 30′. The adherent portion 28′ remains bonded to the container 22′ while the removable portion 30′ may be discarded. It may be desireable to have secondary failures near the rim 21′ to leave a debris portion 31′ adhered to the rim 21′ of the container 22′ opposite the adherent portion 28′. In general the secondary failures can occur in any layer (12,14,16,18). In use the user will remove the remainder of the innerseal by inserting a finger and tearing the adherent portion 28″ away from the rim 21″.

Figure 4:
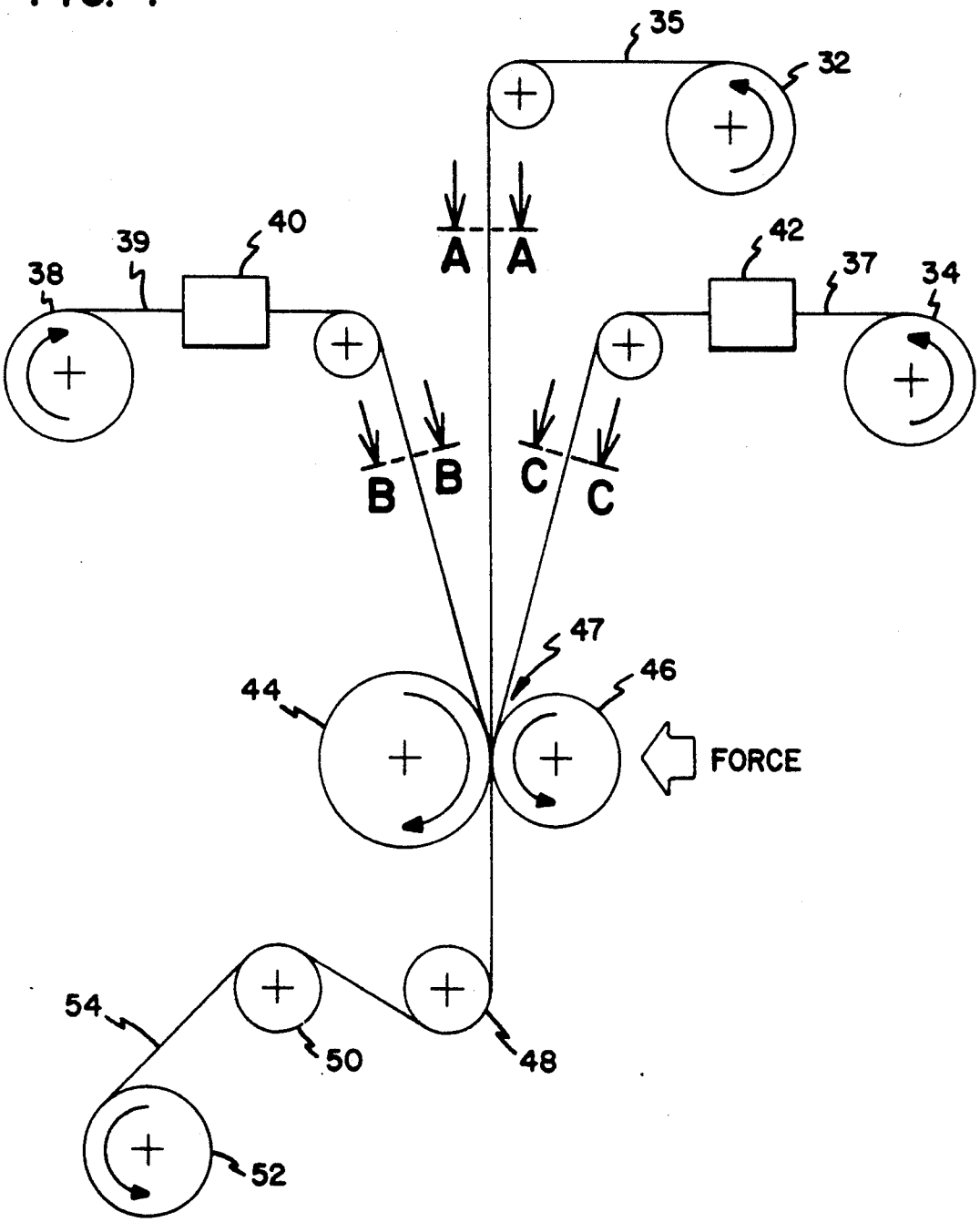
FIG. 4 is a schematic diagram for the process of making innerseal web.

FIG. 4 shows a schematic process for making innerseal web 54 from a sealing web 37, a tabbing web 39, and a tab liner web 35. The preferred sealing webs for this process are members of the "Safe-Gard TM" brand series of products, and include SG-100, SG-101, SG-102 and SG-104A products which are manufactured by Minnesota Mining and Manufacturing of Maplewood, Minn. The SG-100 is used in the examples and it is a 1.5 mil polyethylene heat seal layer backed by a 1.0 mil aluminum foil. The preferred tab liner web 35 is paper, although other de-tackifying layers such as polyester un-plasticized polyvinyl chloride, polypropylene, or silicone-treated paper may be substituted. The preferred tabbing web 39 is "Scotchpak ®" brand 470 heat sealable polyester film which is manufactured by Minnesota Mining and Manufacturing of Maplewood Minn. This material comprises a layer of polyester as the top reinforcing layer 18 coupled to a heat sealable copolymer as the intermediate bonding layer 16.

Figure 4A:
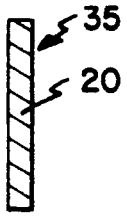
FIG. 4A is a detail of the liner web.
Figure 4B:
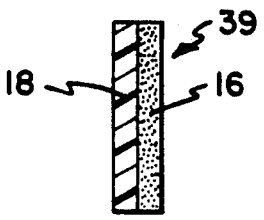
FIG. 4B is a detail of the tabbing web.
Figure 4C:
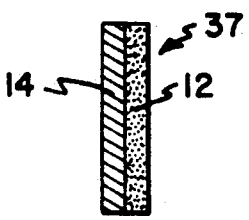
FIG. 4C is a detail of the sealing web.

The tabbing web 39 shown in detail FIG. 4B, is fed from a tabbing web supply roll 38 to a nip 47 formed by hot can 44 and chill roll 46. A center ply of tab liner web 35 shown in detail FIG. 4A, is fed from tab liner supply roll 32 through the nip 47. The two webs pass through the nip 47 to form innerseal web 54. Alternatively, the tabbing web 39 is passed through a treatment station 40 which can be a corona discharge station. It is believed that flame treatment may be substituted for the corona discharge. In a similar fashion the sealing web 37 shown in detail FIG. 4C, is fed from a sealing web supply roll 34, and passed through a corona treatment station 42 to clean the aluminum surface of the sealing web 37. The three webs are passed though a nip 47 formed between a hot can 44 and a chill roll 46. The hot can 44 is operated above ambient temperature and the chill roll 46 is operated below ambient temperature. The hot can 44 used for preparing the illustrative examples includes a remotely heated reservoir of oil which is circulated through the hot can 44. It is expected that both cross-web and down-web product variation may be reduced by the substitution of a thermostatically controlled and electrically heated roll for the hot can 44.

After the innerseal web 54 is formed in the nip 47, the innerseal web 54 is sequentially cooled by passage around a first cooling roll 48 and a second cooling roll 50. The temperatures of the cooling rolls depends in part upon humidity and ambient temperature. The objective of sequential cooling is to eliminate condensation on the innerseal web and to gradually cool the innerseal web to avoid shrinkage and the formation of wrinkles in the innerseal web.

It is theorized that the treatment stations (40 and 42) form carboxyl and carbonyl groups in the polymeric webs which make up the materials and clean the surface of the aluminum layer. It is believed that this process improves the adhesion between the tabbing web and the sealing web.

FIG. 5 shows a segment of the resultant innerseal web 54. Innerseals 10 may be cut to the desired size and shape from the innerseal web 54 as seen in the figure with the size of the five layer grip tab side of the innerseal controlled by the position of the cut. Typically the innerseal 10 will be combined with a cap liner 11 made from paper pulp board or the like and the composite structure will be placed into an appropriately sized cap 23. The cap 23 and the cap liner 11 together position the innerseal 10 for the remote heat sealing operation.

FIG. 6 shows the placement of a cap 23 onto the rim 21 of a container 22. The innerseal shown in phantom view is pressed into conformity with the rim 21 by the cap liner 11, when the cap 23 is placed on the container 22.

Figure 7:
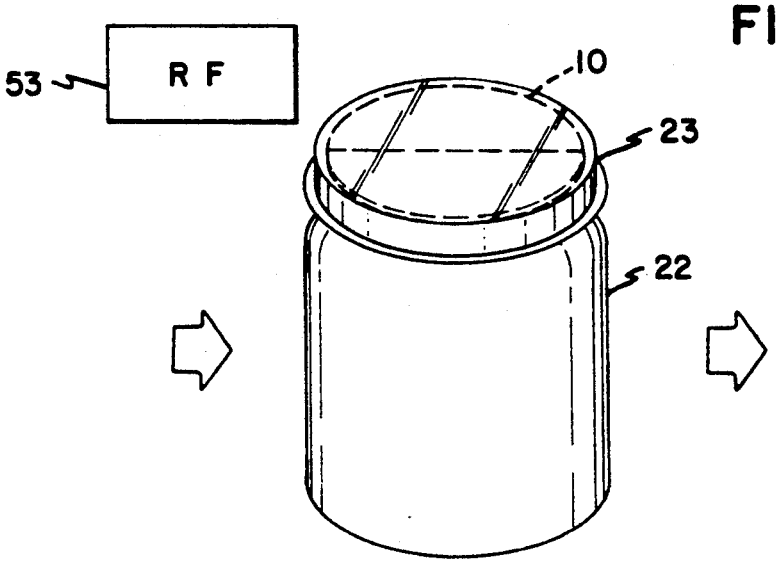
FIG. 7 is a schematic diagram of the process of adhering an innerseal to a container.

FIG. 7 shows the container 22 assembly being passed through an induction heater 53.

Figure 8:
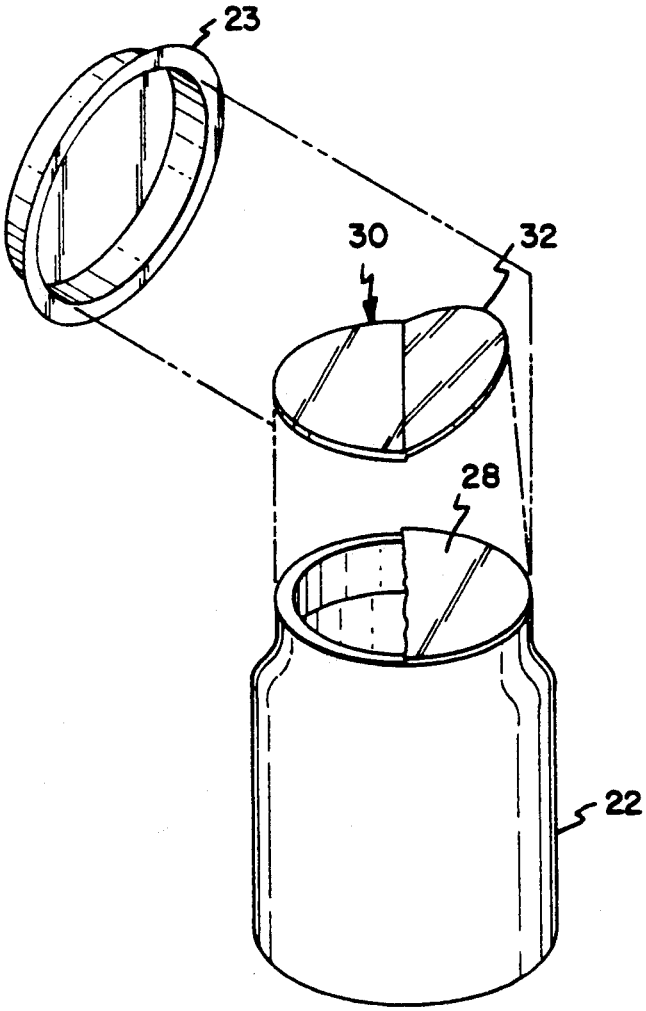
FIG. 8 is a schematic diagram showing a removal of an induction sealed innerseal.

FIG. 8 shows the removal of the innerseal 10 from the container 22, and shows an adherent portion 28 still bonded across the rim 21 of the container 22. The removable portion 30 seen in the drawing includes the grip tab 32.

Figure 9:
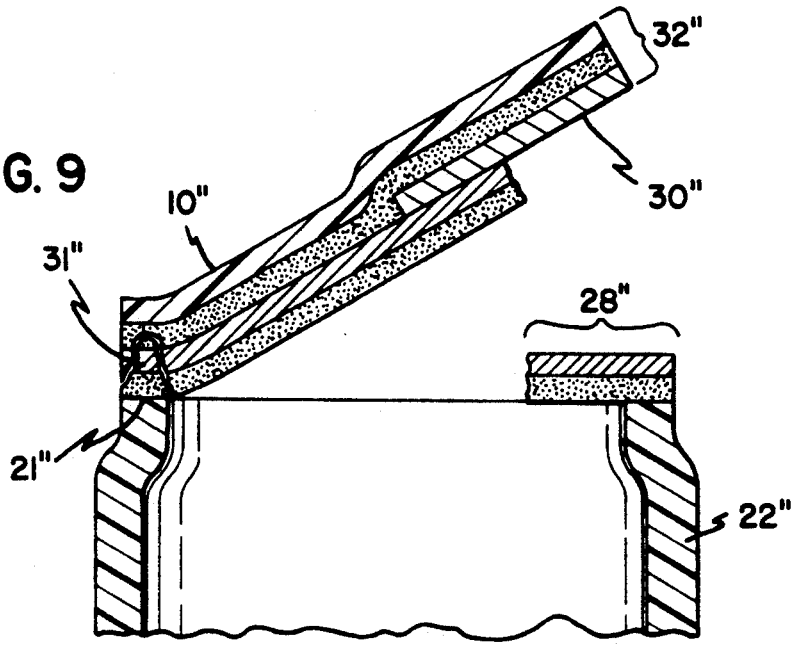
FIG. 9 is a schematic diagram showing an alternative removal of an induction sealed innerseal.

FIG. 9 shows the an alternate result of removal of the innerseal 10'' from the container 22'', and shows an adherent portion 28'' still bonded onto the rim 21'' of the container 22''. The removable portion 30'' seen in the drawing includes the grip tap 32''. In this figure the secondary failure has occurred in the intermediate bonding layer 16 leaving adherent portion 31'' on the rim 21''.

EXAMPLES

In the examples, various innerseal webs were assembled according to the process parameters given previously. The hot can 44 had a twenty-four inch diameter and a sixteen inch wide face and processing conditions are shown below. Innerseals were cut to a circular shape 28 mm in diameter from the webs and applied to polyethylene bottles with 28 mm snap caps. Thus the innerseals were positioned against the rim of the container by the cap and the pulp backing material within the caps. The capped bottles were then passed through an induction tunnel powered by an Enercon 2 KW low frequency induction sealer (model LM-2752), available from Enercon Industries Corporation, Milwaukee, Wis. The induction sealer was operated at 85% of full power. The bottles were moved through the unit at 50 fpm.

The innerseals produced in accordance with the examples were all successful. These innerseals were removed by hand and in each case the innerseal facing tore along the tab base during removal leaving a substantial portion of the rim aperture covered.

| EXAMPLE 1 | |
|---|---|
| Hot can (44) temperature in degrees Fahrenheit | 221 |
| Nip (47) pressure in PSIG | 20 |
| Web speed in feet per minute | 20 |
| Corona treatment station (40) in Kilowatts | 1.2 |
| Corona treatment station (42) in Kilowatts | .8 |
| Tabbing web material (39) | Scotchpak ® 470 |
| Sealing web material (37) | Safe-Gard TM SG-100 |
| Tab liner web material (35) | Paper (20 lb ream basis weight) |

| EXAMPLE 2 | |
|---|---|
| Hot can (44) temperature in degrees Fahrenheit | 290 |
| Nip pressure in PSIG | 20 |
| Web speed in feet per minute | 80 |
| Corona treatment station (40) in Kilowatts | 1.2 |
| Corona treatment station (42) in Kilowatts | .8 |
| Tabbing web material (39) | Scotchpak ® 470 |
| Sealing web material (37) | Safe-Gard TM SG-100 |
| Tab liner web material (35) | Paper (20 lb ream basis weight) |

| EXAMPLE 3 | |
|---|---|
| Hot can (44) temperature in degrees Fahrenheit | 341 |
| Nip (47) pressure in PSIG | 20 |
| Web speed in inches per second | 80 |
| Corona treatment station (40) in Kilowatts | 1.2 |
| Corona treatment station (42) in Kilowatts | .8 |
| Tabbing web material (39) | Scotchpak ® 470 |
| Sealing web material (37) | Safe-Gard TM SG-100 |
| Tab liner web material (35) | Paper (20 lb ream basis weight) |

| EXAMPLE 4 | |
|---|---|
| Hot can (44) temperature in degrees Fahrenheit | 385 |
| Nip (47) pressure in PSIG | 20 |
| Web speed in inches per second | 50 |
| Corona treatment station (40) in Kilowatts | off |
| Corona treatment station (42) in Kilowatts | .8 |
| Tabbing web material (39) | Scotchpak ® 470 |
| Sealing web material (37) | Safe-Gard TM SG-100 |
| Tab liner web material (35) | Paper (20 lb ream basis weight) |

INNERSEAL FAILURE

As presently understood the failure of the preferred aluminum base layer 14 results from stress concentrations along the grip tab base 33. These stress concentrations cause the metallic foil to fail preferentially. It appears that the bond between the bottom bonding layer 12 and the rim 21 of the container 22 must be quite strong, and the bond between the grip tab 32 and the base layer 14 must be quite strong. The induction sealing process which seals the innerseal 10 to the rim 21 of the container 20 also appears to improve bond strength between the grip tab 32 and the base layer 14. To facilitate failure at or along the grip tab base 33, the bond strength between the grip tab 32 and the base layer 14 is preferably greater than the strength of the base layer 14. Thus, the innerseal fails along the grip tab base 33 when force, sufficient to tear the base layer 14, is exerted on the grip tab 32.

When these conditions are met the grip tab forces are directed to the base layer 14 and concentrate along the grip tab base 33. The stress concentration along the tab base 33 facilitates the failure of the base layer 14 near the grip tab base 33 usually at the intersection of the tab base 33 and the edge of the container rim 21. However it should be appreciated that defects in the base layer 14 may cause the tear to originate elsewhere in the innerseal 10. From this analysis it appears to be important that the bottom sealing layer not be "reinforced" with polyester materials or the like.

We claim:

1. An innerseal for application to the rim of a container, comprising:

(a) a bottom bonding layer for bonding the innerseal to the container rim;

(b) a base layer coupled to said bottom bonding layer;

(c) a grip tab comprising a free portion for grasping by a user and a composite portion connected to said base layer, said free portion and said composite portion meeting at a junction defined by a chord across the container rim; and (d) means for tearing through said base layer at said junction and for progressively circumferentially delaminating the portion of said base layer connected to said composite portion from the rim in response to a removal force applied to said free portion;

whereby an adherent innerseal portion remains bonded to the rim and a removable innerseal portion may be removed from the rim.

2. The innerseal of claim 1, wherein said bottom bonding layer comprises polyolefin.

3. The innerseal of claim 1, wherein said base layer comprises aluminum foil.

4. The innerseal of claim 1, wherein said bottom bonding layer is heat sealable, and wherein said base layer is adapted for remote heating.

5. The innerseal of claim 1, wherein said composite portion comprises a majority of the area of said base layer.

* * * * *